US007819488B2

(12) United States Patent
Lee et al.

(10) Patent No.: US 7,819,488 B2
(45) Date of Patent: Oct. 26, 2010

(54) DOOR OPENING DEVICE AND REFRIGERATOR HAVING THE SAME

(75) Inventors: Dong Hyun Lee, Gwangju (KR); Jin Ho Kim, Gwangju (KR); Jae Koog An, Gwangju (KR); Young seok Cho, Jellanam-do (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 478 days.

(21) Appl. No.: 11/882,584

(22) Filed: Aug. 2, 2007

(65) Prior Publication Data

US 2008/0083243 A1 Apr. 10, 2008

(30) Foreign Application Priority Data

Oct. 9, 2006 (KR) ..... 10-2006-0097988
Mar. 20, 2007 (KR) ..... 10-2007-0027162

(51) Int. Cl.
*A47B 96/04* (2006.01)

(52) U.S. Cl. ..... 312/405; 312/296

(58) Field of Classification Search ..... 312/296, 312/401, 324, 405, 326–329, 222, 215; 292/194, 292/197, 215, 251.5, DIG. 71; 49/276, 277, 49/278, 256; 62/441, 449; 74/567, 569
See application file for complete search history.

(56) References Cited

U.S. PATENT DOCUMENTS 178,062 A * 5/1876 Jordan et al. ..... 74/567
457,294 A * 8/1891 Tilden ..... 418/166
3,110,438 A * 11/1963 Leckner ..... 232/43.4
4,760,297 A * 7/1988 Schemmann et al. ..... 310/47
4,791,327 A * 12/1988 Bertram et al. ..... 310/41
5,012,147 A * 4/1991 Bertram et al. ..... 310/80
5,488,212 A * 1/1996 Fukushi et al. ..... 200/400
6,105,522 A * 8/2000 Kato ..... 112/220
6,375,291 B1 * 4/2002 Nam et al. ..... 312/405
6,407,912 B1 * 6/2002 Chen et al. ..... 361/679.58
2006/0097612 A1 * 5/2006 Park ..... 312/405
2006/0107597 A1 * 5/2006 Jin et al. ..... 49/149

FOREIGN PATENT DOCUMENTS

KR 10-2006-0040436 A 5/2006

* cited by examiner

*Primary Examiner*—Darnell M Jayne
*Assistant Examiner*—Andres Gallego
(74) *Attorney, Agent, or Firm*—Staas & Halsey LLP

(57) ABSTRACT

A door opening device decreasing operational stages of a driving motor when opening a door and a refrigerator having the door opening device are disclosed. The door opening device selectively opens a first door and a second door and includes an operating member which selectively pressurizes the first door and the second door to be opened by rotation, a rotating cam including a plurality of protruding portions which contact the operating member to rotate the operating member and a plurality of depressed portions which are spaced apart from the operating member, the protruding portions and the depressed portions being formed alternately along a rotational direction of the rotating cam, a driving motor rotating the rotating cam in a forward direction and a reverse direction, and a return part returning the operating member to an initial position after at least one of the first door and the second door is opened.

24 Claims, 13 Drawing Sheets

DOOR OPENING DEVICE AND REFRIGERATOR HAVING THE SAME

CROSS-REFERENCE TO RELATED APPLICATIONS

This application claims the benefit of Korean Patent Application Nos. 2006-0097988 and 2007-0027162, filed on Oct. 9, 2006 and Mar. 20, 2007, respectively, in the Korean Intellectual Property Office, the disclosure of which is incorporated herein by reference.

BACKGROUND

1. Field

The present invention relates to a refrigerator, and more particularly to a door opening device and a refrigerator having the same which enables a user to easily open the door.

2. Description of the Related Art

Generally, in the case of a large capacity refrigerator, a door to open and close a storage compartment is large and heavy, so a relatively large physical force is required to open the door. Especially when the pressure difference between the inside of the storage compartment and the outside is large due to a sharp temperature drop in the storage compartment, more physical force is required to open the door. Accordingly, a recent tendency is that the refrigerator is equipped with a door opening device which enables a user to easily open the door by pushing the door in the opening direction when the user intends to open the door.

Korean Patent Laid-open Publication No. 2006-40436 discloses a refrigerator equipped with a door opening device. The disclosed refrigerator is a side-by-side refrigerator, which has storage compartments partitioned at both sides, and a left door and a right door to open and close the respective storage compartments. The door opening device includes a driving motor which is rotated in a forward direction, and a reverse direction and a main cam which is rotated by the driving motor. The door opening device further includes a first sub-cam which is operated by the main cam to open the left door and a second sub-cam which is operated by the main cam to open the right door.

When the driving motor is driven to rotate the main cam in a clockwise direction, the first sub-cam is operated to open the left door. When the driving motor is driven to rotate the main cam in a counterclockwise direction, the second sub-cam is operated to open the right door.

However, the above conventional door opening device has a problem that the driving motor should be rotated twice to open one door, i.e., the process of rotating the motor in a first direction (the forward direction) to rotate the main cam and the process of rotating the motor in a second direction (the reverse direction) to return the main cam to an initial position after the door is opened. In other words, the driving motor has to be rotated in the first direction and subsequently rotated in the second direction. Accordingly, the driving motor is driven frequently, and the resulting lifespans of the driving motor and the relay controlling the driving motor are shortened.

Further, when opening one door (a first door) and consecutively opening the other door (a second door), the conventional door opening device performs the process of rotating the driving motor in the first direction to open the first door, the process of reverse rotating the driving motor in the second direction to return to the initial position, the process of further rotating the driving motor in the second direction to open the second door, and the process of rotating the driving motor in the first direction to return to the initial position. Accordingly, the doors cannot be opened swiftly because of the multiple operational stages of the driving motor.

SUMMARY

The present invention solves the above problems. It is an aspect of the embodiments to provide a door opening device which is capable of decreasing the operational stages of a driving motor when opening a door, thereby elongating lifespans of the driving motor and other related components.

It is another aspect of the embodiments to provide a door opening device which is capable of swiftly performing opening of the door.

It is yet another aspect of the embodiments to provide a refrigerator having the above door opening device.

Additional aspects and/or advantages of the embodiments will be set forth in part in the description which follows and, in part, will be apparent from the description, or may be learned by practice of the embodiments.

The foregoing and/or other aspects are achieved by providing a door opening device which selectively opens a first door and a second door, including: an operating member selectively pressurizing the first door and the second door to be opened by rotation; a rotating cam including a plurality of protruding portions contacting the operating member to rotate the operating member and a plurality of depressed portions spaced apart from the operating member, the protruding portions and the depressed portions being formed alternately along a rotational direction of the rotating cam; a driving motor rotating the rotating cam in a forward direction and a reverse direction; and a return part returning the operating member to an initial position after at least one of the first door and the second door is opened.

The rotating cam is configured such that the protruding portions are formed at 120 degrees between two adjacent protruding portions.

Alternatively, the rotating cam may be configured such that the protruding portions are formed at 90 degrees between two adjacent protruding portions.

Alternatively, the rotating cam may be configured such that the protruding portions are formed at 180 degrees with respect to one another.

The door opening device further includes a sensing unit detecting a rotational position of the rotating cam to control operation of the driving motor.

The sensing unit may include magnets provided at front ends of the protruding portions and a sensor provided outside the rotating cam to sense the magnets.

The operating member includes a first extending portion extending toward the rotating cam and having a length such that a front end contacts the protruding portions and is spaced apart from the depressed portions, a second extending portion extending toward an inner surface of the first door and pressurizing the first door when rotating in a first direction, and a third extending portion extending toward an inner surface of the second door and pressurizing the second door when rotating in a second direction.

The operating member is configured such that a length between a front end of the first extending portion and a rotational center of the operating member is larger than a length between a front end of the second extending portion or the third extending portion and the rotational center.

The operating member further includes rollers provided at front ends of the first extending portion, the second extending portion and the third extending portion.

Each of the rollers has an anti-vibration band provided around an outer surface thereof.

The first extending portion of the operating member is aligned with the depressed portion of the rotating cam in an initial state.

The door opening device further includes a weight mounted on at least one of the first extending portion, the second extending portion and the third extending portion and disposed at a position distant from a rotational center.

The door opening device further includes: a first curved protrusion formed at an inner surface of the first door; and a second curved protrusion formed at an inner surface of the second door and positioned adjacent to the first curved protrusion. The operating member includes a first extending portion extending toward the rotating cam and having a length such that a front end contacts the protruding portions of the rotating cam and is spaced apart from the depressed portions of the rotating cam, and a second extending portion extending between the first curved protrusion and the second curved protrusion and selectively pressurizing the first curved portion and the second curved protrusion according to a rotational direction of the operating member.

The door opening device further includes a weight mounted on at least one of the first extending portion and the second extending portion and disposed at a position distant from a rotational center of the operating member.

The door opening device further includes a rotation resistive unit applying rotation resistance to the operating member to rotate the operating member slowly.

The rotation resistive unit may include a rotary type oil damper mounted to a rotational center portion of the operating member.

The return part may be configured as a spring providing a restoring force to the operating member.

The first door and the second door are provided with handles, and the door opening device further includes manipulating parts provided at the handles to control operation of the driving motor.

The foregoing and/or other aspects are achieved by providing a door opening device opening a door, including: an operating member pressurizing the door to be opened by rotation; a rotating cam including a plurality of protruding portions contacting the operating member to rotate the operating member and a plurality of depressed portions spaced apart from the operating member, the protruding portions and the depressed portions being formed alternately along a rotational direction of the rotating cam; a driving motor rotating the rotating cam; and a return part returning the operating member to an initial position after at least one of the first door and the second door is opened.

The foregoing and/or other aspects are achieved by providing a refrigerator including a main body having a first storage compartment and a second storage compartment partitioned from each other, a first door opened and closed to access the first storage compartment, a second door opened and closed to access the second storage compartment, and a door opening device selectively opening the first door and the second door, the door opening device including: an operating member selectively pressurizing the first door and the second door to be opened by rotation; a rotating cam including a plurality of protruding portions contacting the operating member to rotate the operating member and a plurality of depressed portions spaced apart from the operating member, the protruding portions and the depressed portions being formed alternately along a rotational direction of the rotating cam; a driving motor rotating the rotating cam in a forward direction and a reverse direction; and a return part returning the operating member to an initial position after either the first door or the second door is opened.

The foregoing and/or other aspects are achieved by providing a refrigerator including a main body having a storage compartment, a door opened and closed to access the storage compartment, and a door opening device opening the door, the door opening device including: an operating member pressurizing the door to be opened by rotation; a rotating cam including a plurality of protruding portions contacting the operating member to rotate the operating member and a plurality of depressed portions spaced apart from the operating member, the protruding portions and the depressed portions being formed alternately along a rotational direction of the rotating cam; a driving motor rotating the rotating cam; and a return part returning the operating member to an initial position after the door is opened.

BRIEF DESCRIPTION OF THE DRAWINGS

These and/or other aspects and advantages of the embodiments will become apparent and more readily appreciated from the following description of the embodiments, taken in conjunction with the accompanying drawings, of which.

DETAILED DESCRIPTION OF THE EMBODIMENTS

Figure 1:
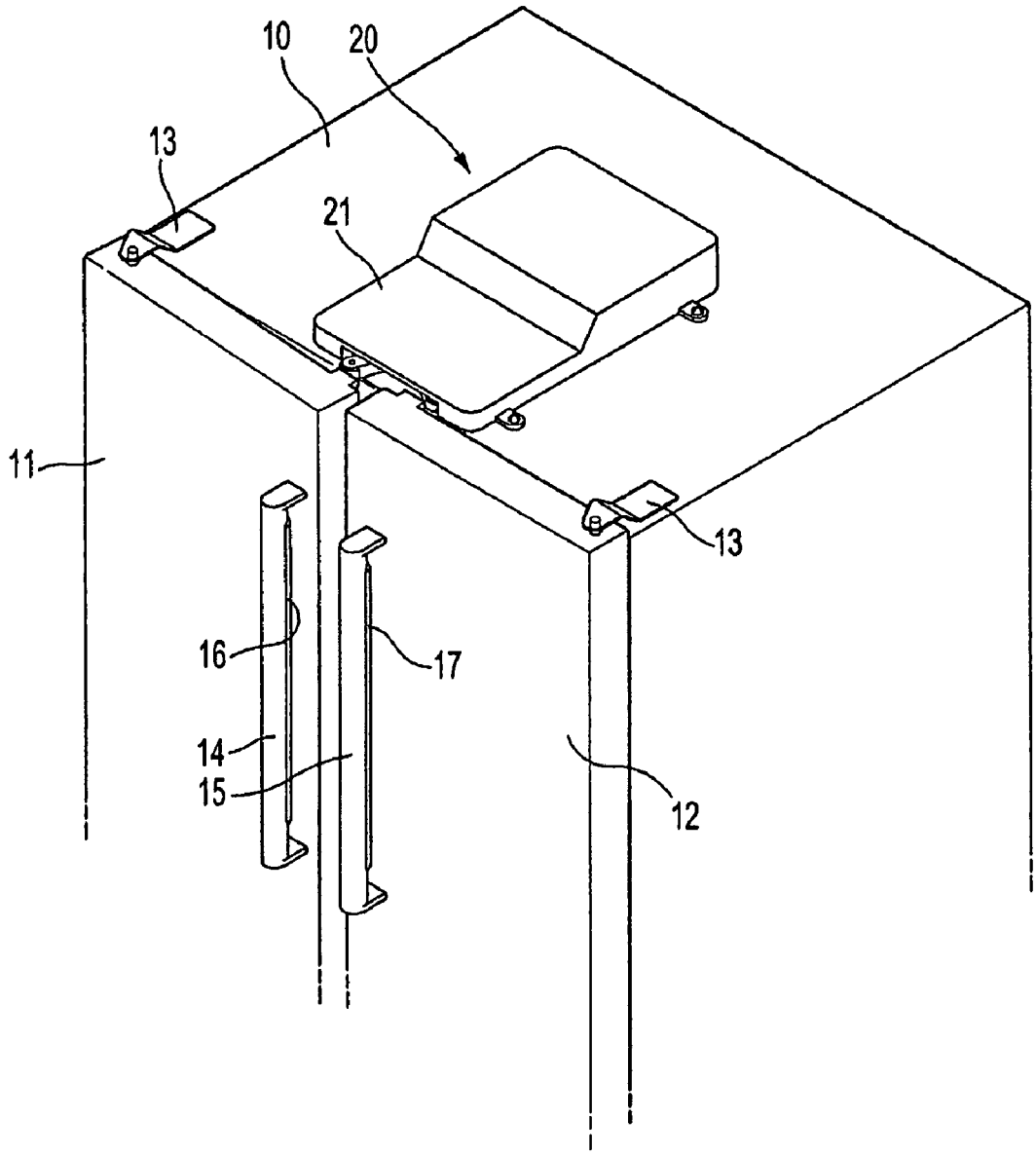
FIG. 1 is a perspective view illustrating a refrigerator equipped with a door opening device in accordance with the embodiments.

Reference will now be made in detail to embodiments, examples of which are illustrated in the accompanying drawings, wherein like reference numerals refer to like elements throughout. The embodiments are described below to explain the present invention by referring to the figures.

FIG. 1 is a perspective view illustrating a refrigerator equipped with a door opening device. The refrigerator includes a main body 10, and a first storage compartment (not shown) and a second storage compartment (not shown) which are partitioned in an interior of the main body 10. A first door 11 and a second door 12 are mounted to a front portion of the main body 10 allowing movement between opened and closed positions to access the first storage compartment and the second storage compartment, respectively. Typically, the first storage compartment is a freezing compartment, and the second storage compartment is a cooling compartment. The first door 11 and the second door 12 are hingedly mounted to the main body 10 by hinge devices 13 coupled to top and bottom portions of the doors 11 and 12. The doors 11 and 12 are respectively provided with handles 14 and 15 at their front surfaces.

A door opening device 20 is mounted to the top of the main body 10. The door opening device 20 functions to push the upper portions of the first door 11 and the second door 12 forward, so that a user can easily open the doors 11 and 12.

Figure 2:
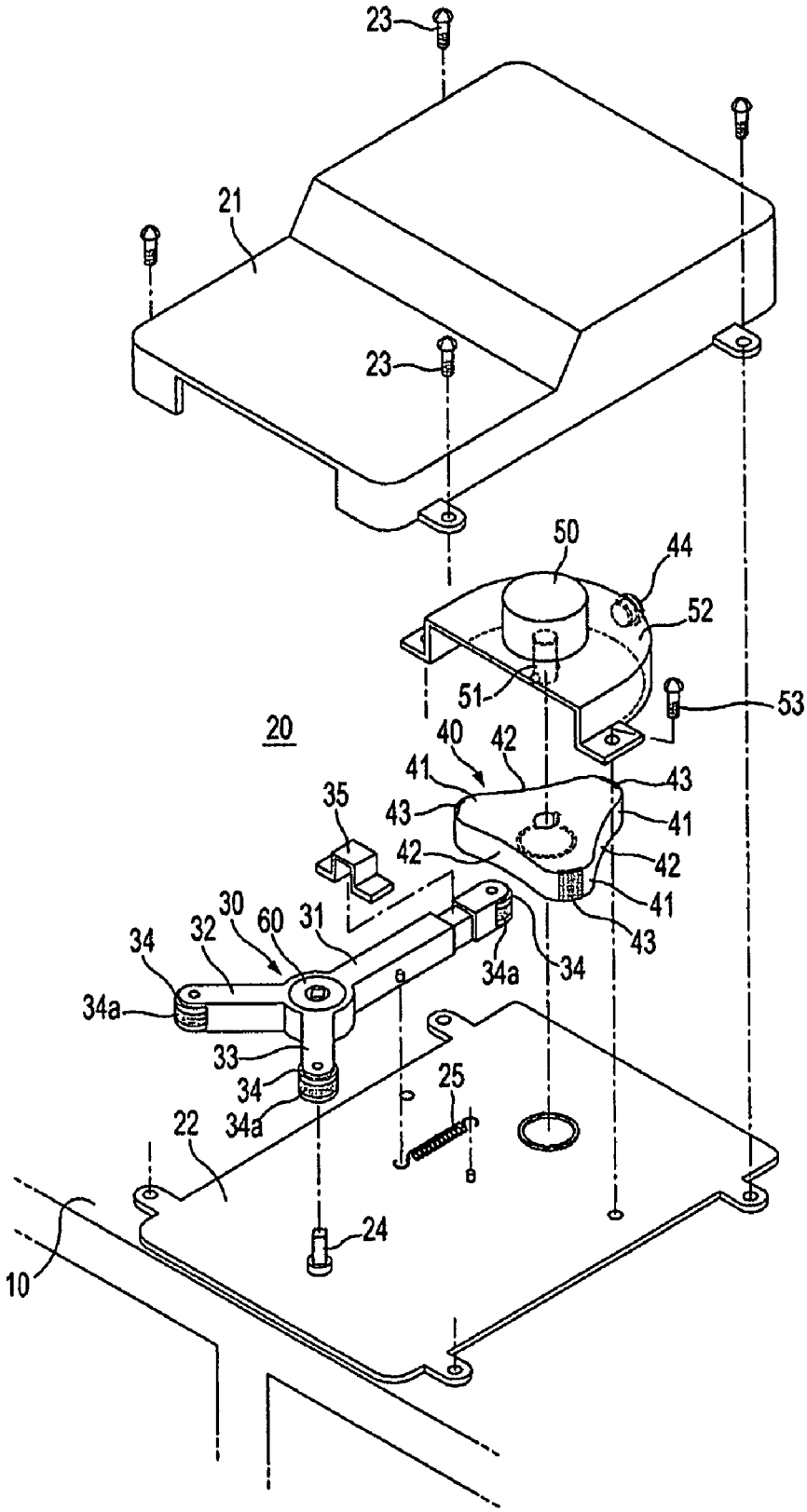
FIG. 2 is an exploded perspective view illustrating a door opening device in accordance with a first embodiment of the embodiments.
Figure 3:
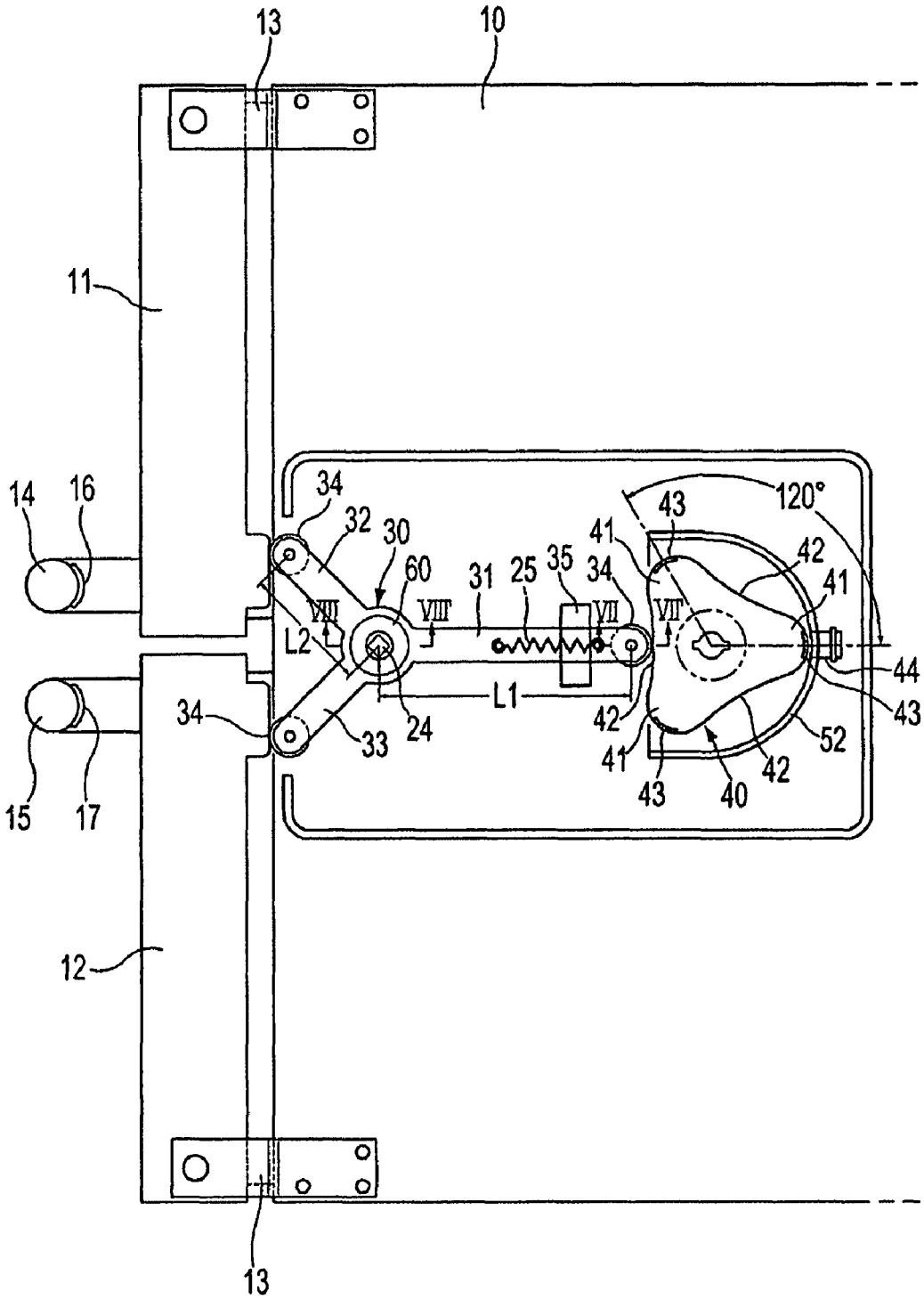
FIG. 3 is a top plan view illustrating a refrigerator equipped with a door opening device in accordance with the first embodiment of the present invention, when doors are closed.

FIGS. 2 to 6 show the door opening device according to a first embodiment. The door opening device 20, as shown in FIGS. 2 and 3, includes an operating member 30 which selectively pressurizes the first and second doors 11 and 12 according to a rotational direction, a rotating cam 40 which rotates the operating member 30, a driving motor 50 which rotates the rotating cam 40 in a forward direction and a reverse direction. The rotating cam 40 is covered with a cam cover 52. All of the above components are accommodated in an upper case 21 and a lower case 22. The lower case 22 is fixed to the top surface of the main body 10, and the upper case 21 is coupled to the lower case 22 by tightening plural fixing screws 23 between the upper case 21 and the lower case 22.

The rotating cam 40 includes three protruding portions 41 which contact the operating member 30 to rotate the same, and three depressed portions 42 which are spaced apart from the operating member 30. The protruding portions 41 and the depressed portions 42 are formed alternately along the rotational direction of the rotating cam 40. Three protruding portions 41 are formed equiangularly, i.e., at 120 degrees between two adjacent protruding portions 41. The protruding portions 41 are formed in a mountain-shaped curve, and the depressed portions 42 are formed in a valley-shaped curve.

The cam cover 52, which covers the rotating cam 40, is fixed to an upper surface of the lower case 22 by tightening fixing screws 53 between the cam cover 52 and the lower case 22, and the driving motor 50 is fixed to a top surface of the cam cover 52. A shaft 51 of the driving motor 50 passes through the cam cover 52 and extends to the interior of the cam cover 52 to be coupled to the rotating cam 40. Therefore, when the driving motor 50 is driven, the rotating cam 40 rotates inside the cam cover 52.

The operating member 30 is rotatably mounted to the upper surface of the lower case 22, in front of the rotating cam 40. For mounting the operating member 30, as shown in FIG. 2, a supporting shaft 24 is provided on the upper surface of the lower case 22.

Figure 4:
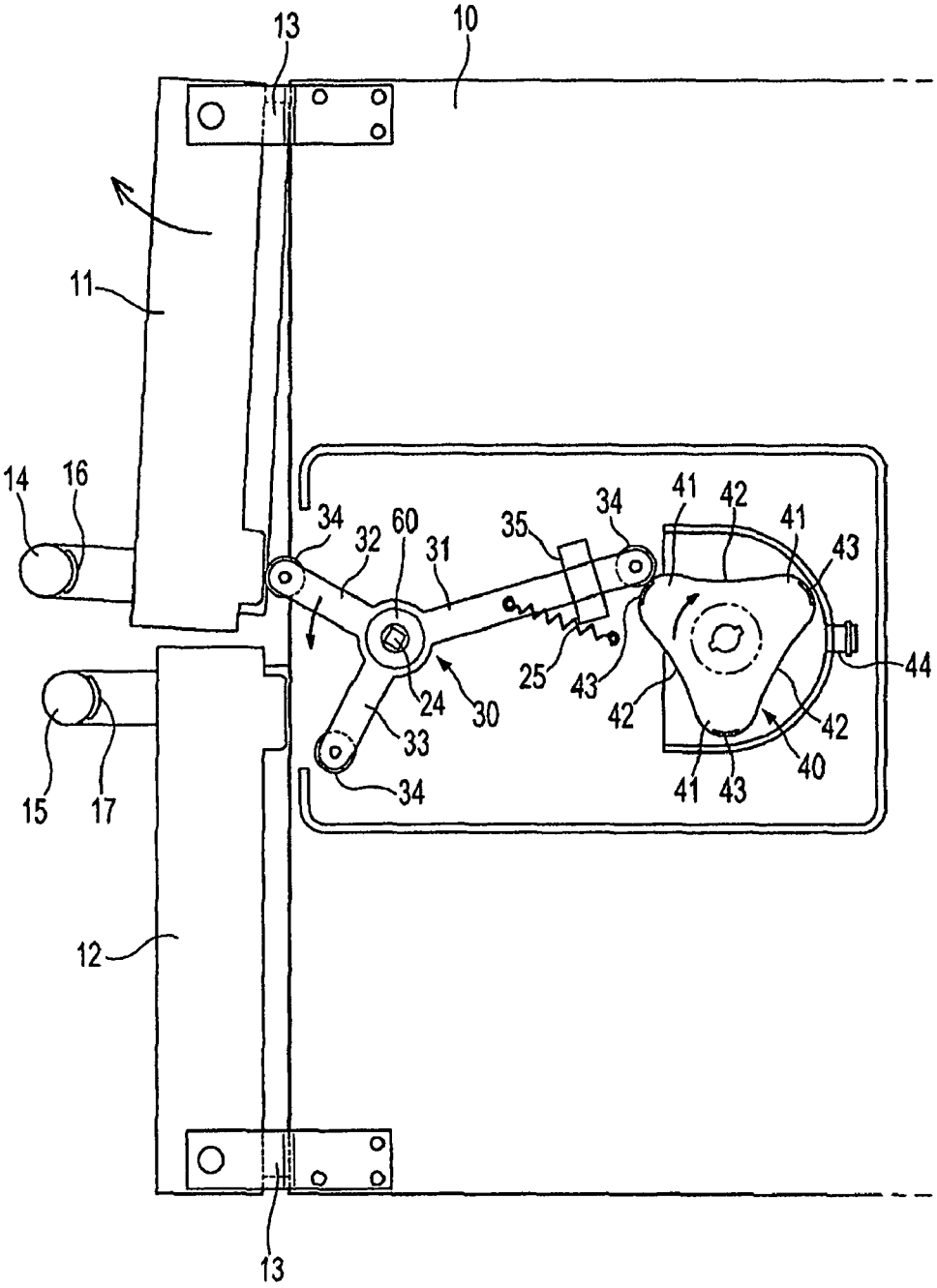
FIG. 4 is a top plan view illustrating a refrigerator equipped with a door opening device in accordance with the first embodiment, when a first door is opened by the door opening device.
Figure 6:
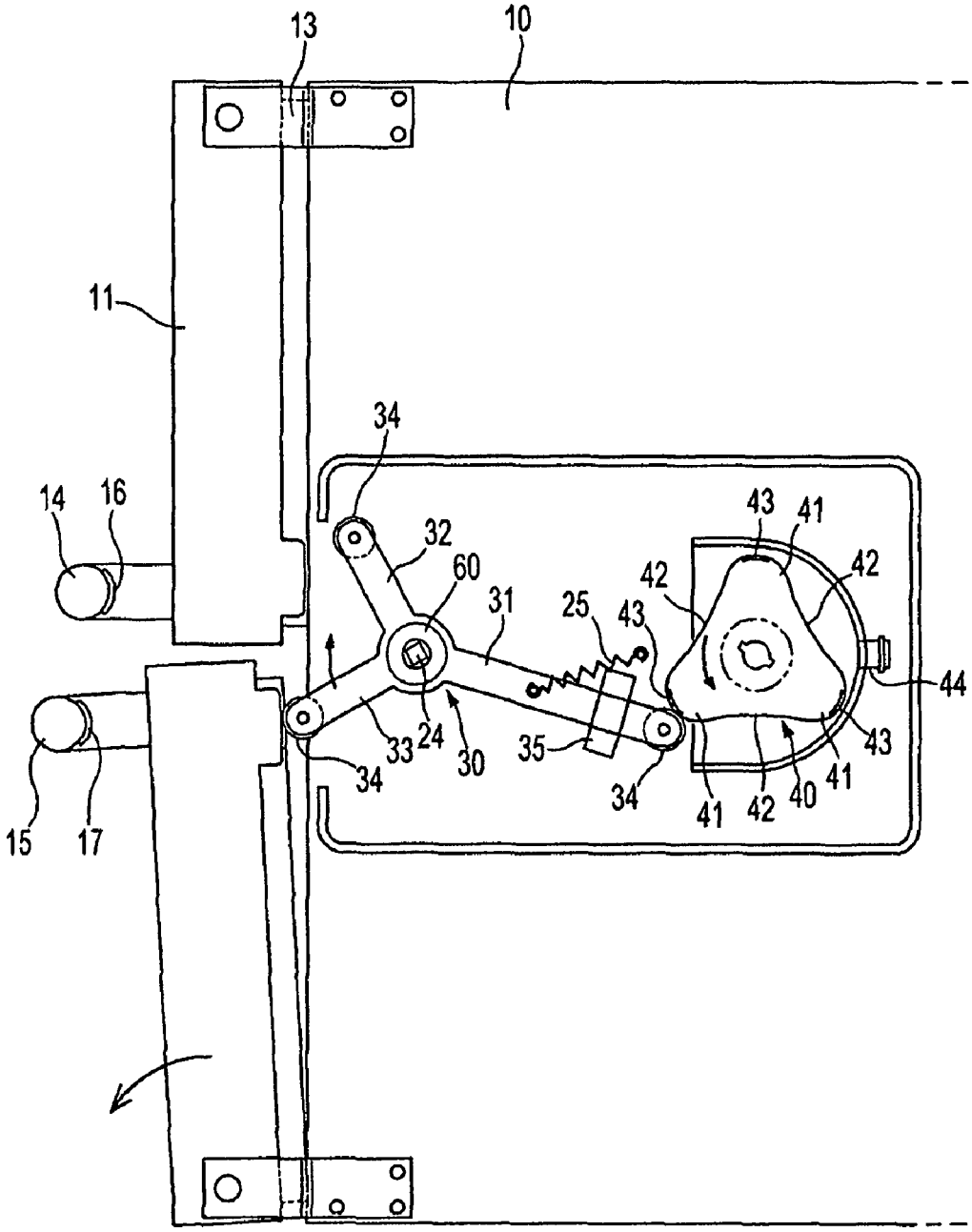
FIG. 6 is a top plan view illustrating a refrigerator equipped with a door opening device in accordance with the first embodiment, when a second door is opened by the door opening device.

As shown in FIG. 3, the operating member 30 includes a first extending portion 31 which extends toward the rotating cam 40 from a rotational center, a second extending portion 32 which extends toward an inner surface of the first door 11 from the rotational center, and a third extending portion 33 which extends toward an inner surface of the second door 12 from the rotational center. The operating member 30 has a "Y" shape. The first extending portion 31 of the operating member 30 has a length such that a front end comes into contact with the protruding portions 41 of the rotating cam 40, but is spaced apart from the depressed portions 42 of the rotating cam 40. Also, a length L1 between a front end of the first extending portion 31 and the rotational center is larger than a length L2 between the front end of the second or third extending portions 32 or 33 and the rotational centerthus using the principle of a lever. As shown in FIGS. 4 and 6, although the rotating cam 40 rotates the first extending portion 31 of the operating member 30 with a relatively small force, the second or third extending portions 32 or 33 pressurize the inner surfaces of the first or second door 11 or 12 with a relatively large force, so that the first and second doors 11 and 12 can be easily opened.

Figure 7:
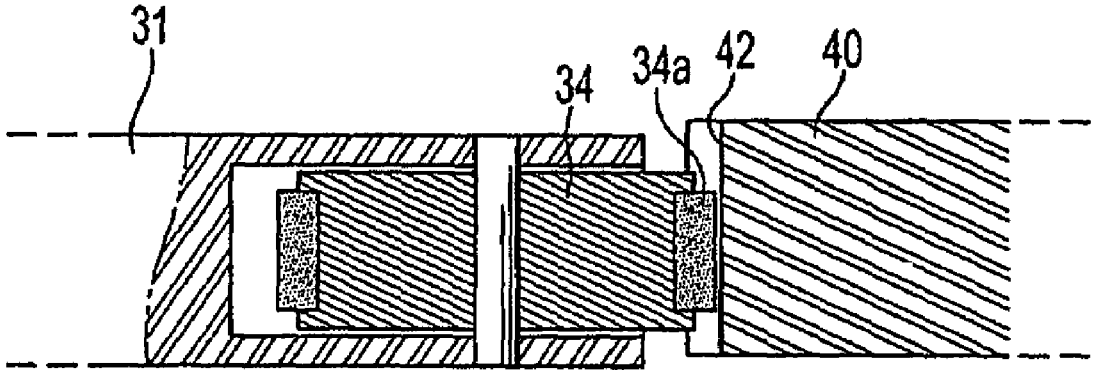
FIG. 7 is a sectional view taken along line VII-VII' in FIG. 3.

The first to third extending portions 31, 32 and 33 of the operating member 30 are respectively provided with rollers 34 at their front ends. The rollers 34 prevent friction between the first extending portion 31 and the rotating cam 40 and friction between the second and third extending portions 32 and 33 and the first and second doors 11 and 12, when the door opening device 20 operates. As shown in FIGS. 2 and 7, each of the rollers 34 is provided with an anti-vibration band 34a around its outer surface, which may be made of silicon, rubber, etc. The anti-vibration band 34a absorbs the shaking or the vibration of the rotating cam 40 and the operating member 30.

The first extending portion 31 of the operating member 30 is provided with a return spring 25 for returning the operating member 30 to its initial position after the door is opened. A first end of the return spring 25 is connected to the first extending portion 31, and a second end of the return spring 25 is connected to the top surface of the main body 10 of the refrigerator, thereby providing an elastic restoring force to the first extending portion 31. Although a coil-type return spring 25 is depicted in the drawings, a torsion spring, a spiral spring, an elastic member such as rubber, and any other type of position-returning device may be used as a part to return the operating member 30 to its initial position.

As described above, the operating member 30 is returned to its initial state (see FIG. 3) by the elastic restoring force of the return spring 25, after the door is opened. In the initial state, the driving motor 50 is controlled to be kept in a non-operating state such that the front end of the first extending portion 31 is aligned with the middle of the depressed portion 42 of the rotating cam 40. In order to control the operation of the driving motor 50, the door opening device 20 further includes a sensing unit that detects the rotational position of the rotating cam 40. The sensing unit may include magnets 43 which are respectively provided at front ends of the protruding portions 41 of the rotating cam 40, and a sensor 44 which is provided at the cam cover 52 to sense the magnets 43. In this embodiment, the sensor 44 is configured as a common-used lead switch. However, the sensing unit is not restricted to the combination of the magnets 43 and the sensor 44. An optical sensor capable of detecting the position of the protruding portions 41 by using light, a limit switch capable of detecting the position of the protruding portions 41 by contacting the same, or any other type of device able to detect the position of the protruding portions 41 may be used as the sensing unit.

As shown in FIGS. 2 and 3, a weight 35 having a predetermined weight is mounted on the first extending portion 31 of the operating member 30 at a position distant from the rotational center of the operating member 30. The weight is used to add the weight to the first extending portion 31 so that the operating member 30 rotates slowly when returning to its initial position by the elastic restoring force of the return spring 25, thereby reducing noise due to collision. Also, the shaking of the operating member 30 can be prevented. The weight 35 can also be mounted on the second extending portion 32 and/or the third extending portion 33. However, because the effect of slowing down the rotation of the operating member 30 is increased as the distance between the rotational center of the operating member 30 and the weight 35 is greater, it is preferable to mount the weight 35 on the first extending portion 31 having the relatively longer length.

Figure 8:
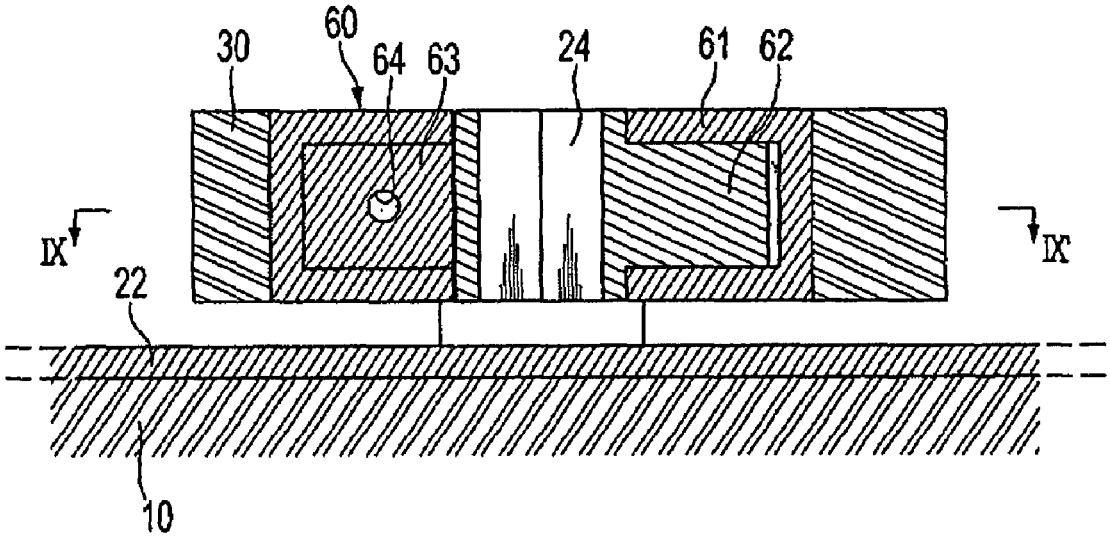
FIG. 8 is a sectional view taken along line VIII-VIII' in FIG. 3.
Figure 9:
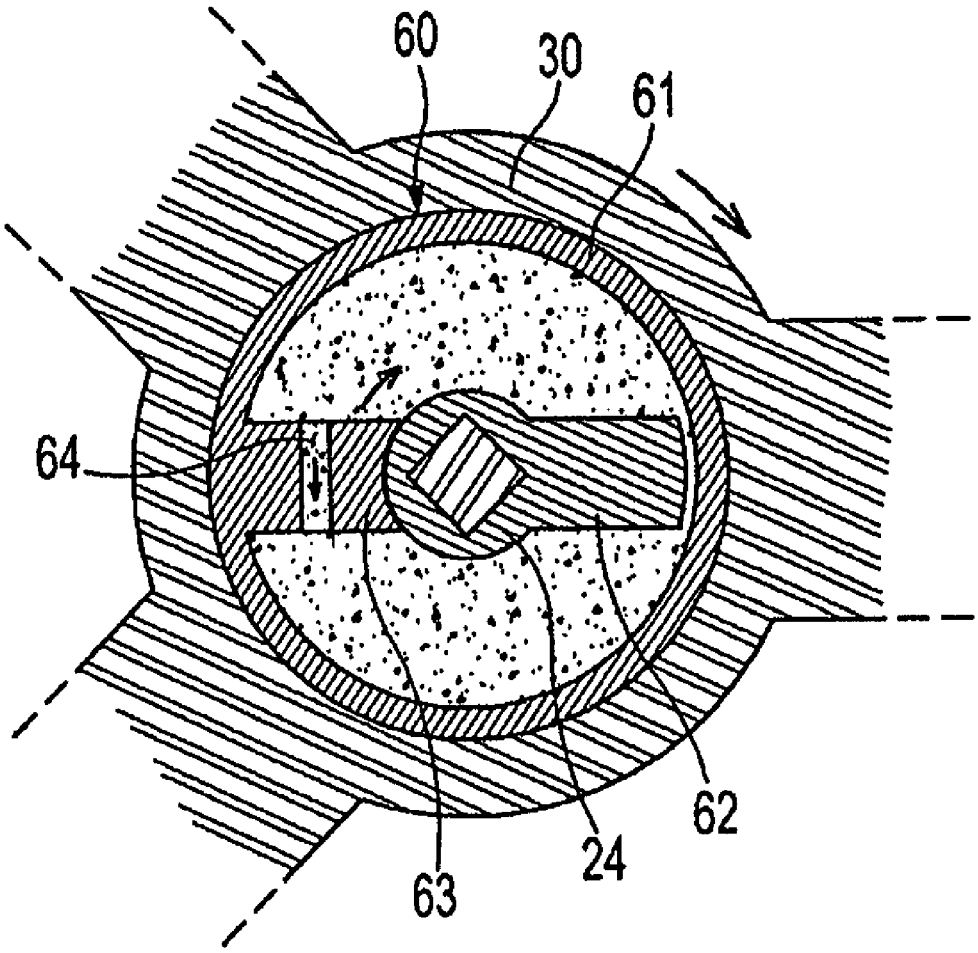
FIG. 9 is a sectional view taken along line IX-IX' in FIG. 8.

A rotation resistive unit 60 is mounted to a rotational center portion of the operating member 30 to apply rotation resistance to the operating member 30. The rotation resistive unit 60 is used to slow down the rotation of the operating member 30 by the rotation resistance when returning to its initial position, thereby minimizing the phenomenon that the operating member 30 collides with the rotating cam 40 or shakes during the operation. The rotation resistive unit 60 can be configured as a rotary type oil damper, for example, which is illustrated in FIGS. 8 and 9.

The rotary type oil damper includes a cylindrical case 61 which contains oil, a fixing blade 62 which is fixed to the supporting shaft 24 disposed inside the case 61, and a rotating blade 63 which is provided on an inner surface of the case 61 to rotate together with the case 61 and has at least one oil passing hole 64. An outer surface of the case 61 is coupled to the operating member 30 to rotate together with the operating member 30. In such an oil damper, when the case 61 and the rotating blade 63 rotate by the operation of the operating member 30, the oil in the case 61 flows through the oil passing hole 64 of the rotating blade 63 to generate flow resistance. Accordingly, the oil damper gives rotation resistance to the operating member 30. In this embodiment, it is exemplified that the oil damper is used as the rotation resistive unit 60, however, a common-used gear type damper or any other type of damper can be used as the rotation resistive unit 60.

The door opening device 20 further includes manipulating parts 16 and 17 which are respectively mounted to the handles 14 and 15 of the first and second doors 11 and 12, so as to control the operation of the driving motor 50. The manipulating parts 16 and 17 may be configured as a sensor which detects that a user grasps the handles 14 and 15 or a power on/off switch which directly controls power applied to the driving motor 50. When the sensor is used for the manipulating parts 16 and 17, the sensing signal from the sensor 44 is transmitted to a controller (not shown) of the refrigerator, and the controller controls the operation of the driving motor 50 in response to the sensing signal. The controller that controls the door opening device 20 may be constituted integrally with or separately from a controller which controls the whole operation of the refrigerator.

Hereinafter, the operation of the door opening device 20 structured as above will be described.

As shown in FIG. 3, if a user does not grasp the handles 14 and 15 in the closed state of the first door 11 and the second door 12, the driving motor 50 does not operate. In other words, the door opening device 20 is kept in the initial state such that the first extending portion 31 of the operating member 30 is aligned with the middle of one of the depressed portions 42 of the rotating cam 40.

Figure 5:
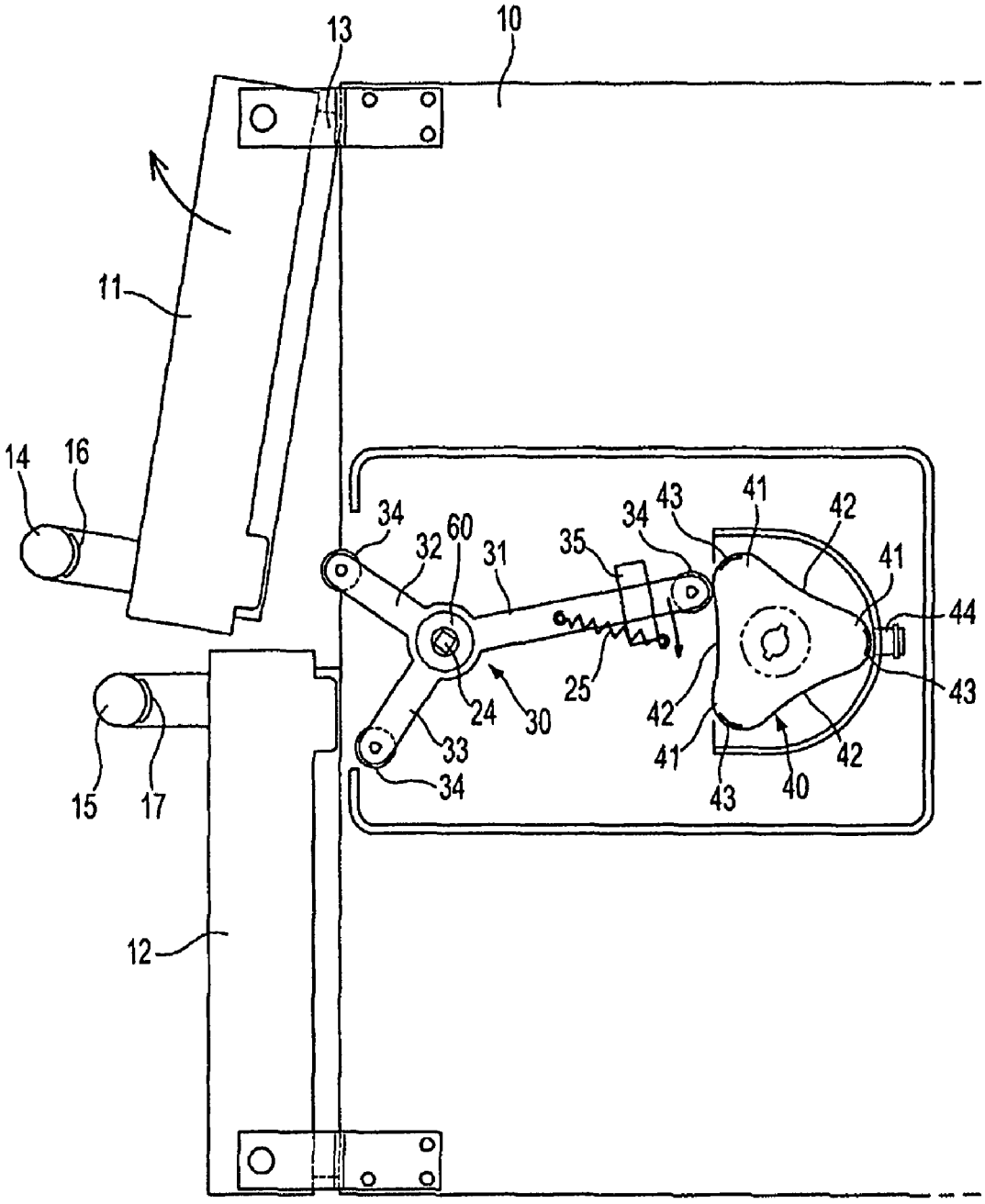
FIG. 5 is a top plan view illustrating a refrigerator equipped with a door opening device in accordance with the first embodiment, when an operating member of the door opening device returns to its initial position.

As shown in FIG. 4, if a user grasps or pulls the handle 14 of the first door 11 to open the first door 11, the manipulating part 16 operates to drive the driving motor 50. The driving motor 50 is driven to rotate the rotating cam 40 in the clockwise direction (the first direction), and one of the protruding portions 41 pushes the first extending portion 31 of the operating member 30, so that the operating member 30 rotates in the counterclockwise direction (the second direction). Accordingly, the second extending portion 32 pushes the inner surface of the first door 11, and so the first door 11 is easily opened. And, as shown in FIG. 5, when the rotating cam 40 rotates by 120 degrees in the clockwise direction and the sensor 44 senses the magnet 43 provided at one of the protruding portions 41, the driving motor 50 stops the operation. Since the rotating cam 40 rotates by 120 degrees, the rotating cam 40 returns to a same state as the initial state. When the pressurization of the protruding portion 41 of the rotating cam 40 to the first extending portion 31 is released, the operating member 30 immediately returns to its initial position by the elastic restoring force of the return spring 25.

As described above, the door opening device 20 can open the door only by the rotation of the driving motor 50 by a predetermined angle in one direction, and returns to the initial state after opening the door. Accordingly, the operational stages of the driving motor 50 can be minimized. As a result, lifespans of the driving motor 50 and other related components are increased.

During the above operation, the rotating cam 40 and the inner surface of the first door 11 contact the anti-vibration band 34*a* of each roller 34, thereby preventing noise due to the shaking or vibration of the operating member 30 and the rotating cam 40. Also, when the operating member 30 returns to its initial position, the operating member 30 rotates slowly by the action of the weight 35 and the rotation resistive unit 60, thereby minimizing the phenomenon that the operating member 30 collides with the rotating cam 40 or shakes.

As shown in FIG. 6, if a user grasps or pulls the handle 15 of the second door 12 to open the second door 12, the manipulating part 17 operates to drive the driving motor 50 in the reverse direction. The driving motor 50 is driven to rotate the rotating cam 40 in the counterclockwise direction (the second direction), and one of the protruding portions 41 pushes the first extending portion 31 of the operating member 30, so that the operating member 30 rotates in the clockwise direction (the first direction). Accordingly, the third extending portion 33 pushes the inner surface of the second door 12, and so the second door 12 is easily opened. When the rotating cam 40 rotates by 120 degrees while opening the second door 12, the driving motor 50 stops the operation of the door opening device, and the operating member 30 returns to its initial position by the elastic restoring force of the return spring 25. As described above, because the doors 11 and 12 are opened only by the rotation of the driving motor 50 in any one direction, the operational stages of the driving motor 50 can be minimized.

Also, when opening the first door 11 and the second door 12 consecutively, the doors 11 and 12 can be opened only by a simple operation of the driving motor 50 such that the driving motor 50 rotates in the clockwise direction and subsequently rotates in the counterclockwise direction. Accordingly, in comparison to a conventional device, the operational stages of the driving motor 50 decrease considerably, and as a result the doors 11 and 12 can be opened swiftly.

Figure 10:
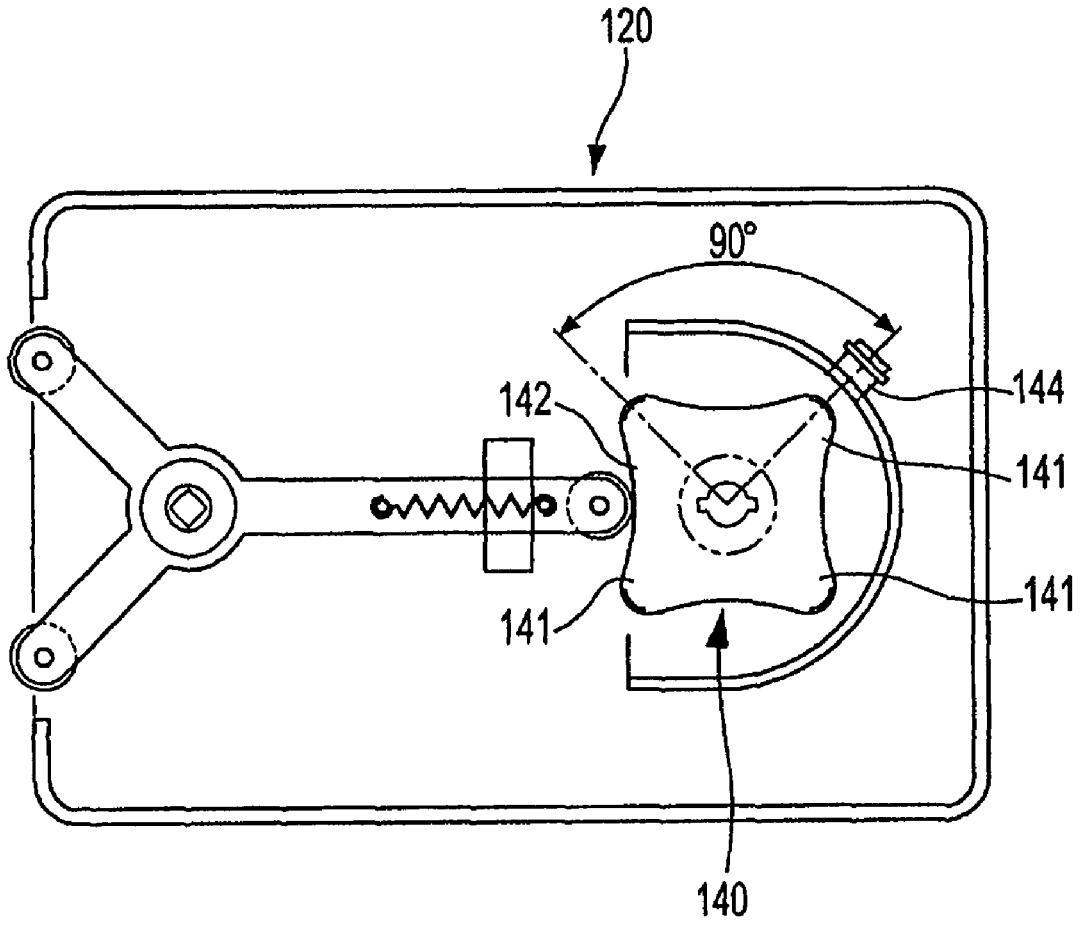
FIG. 10 is a top plan view illustrating a door opening device in accordance with a second embodiment.

FIG. 10 shows a door opening device in accordance with a second embodiment. A door opening device 120 according to the second embodiment includes a rotating cam 140, which has a different shape from the rotating cam of the previous embodiment. The rotating cam 140 includes four protruding portions 141 and four depressed portions 142. The protruding portions 141 and the depressed portions 142 are formed alternately along the rotational direction. Four protruding portions 141 are formed equiangularly, i.e., at 90 degrees between two adjacent protruding portions 141. The position of a sensor 144 is changed to be aligned with one of the protruding portions 141 in the initial state, compared with the previous embodiment. Other constitutions are the same as in the first embodiment. The overall operation of the second embodiment is the same as that of the first embodiment except that the rotating cam 140 rotates by 90 degrees when opening the door.

Figure 11:
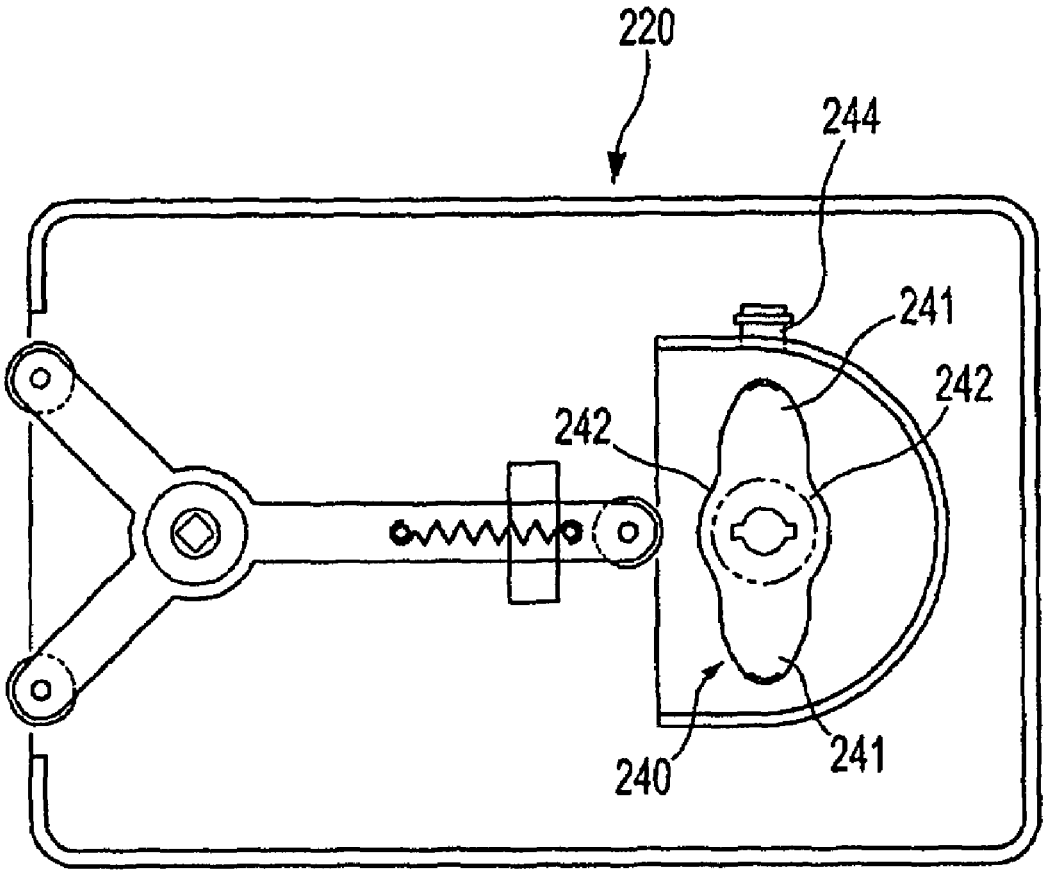
FIG. 11 is a top plan view illustrating a door opening device in accordance with a third embodiment.

FIG. 11 shows a door opening device in accordance with a third embodiment. A door opening device 220 according to the third embodiment includes a rotating cam 240 which has two protruding portions 241 and two depressed portions 242. The protruding portions 241 and the depressed portions 242 are formed alternately along the rotational direction. Two protruding portions 241 are formed at 180 degrees therebetween. The position of a sensor 244 is changed to be aligned with the protruding portion 241 in the initial state, compared with the first embodiment. Other constitutions are the same as in the first and second embodiments. The overall operation of the third embodiment is the same as that of the first and second embodiments except that the rotating cam 240 rotates by 180 degrees when opening the door.

Figure 12:
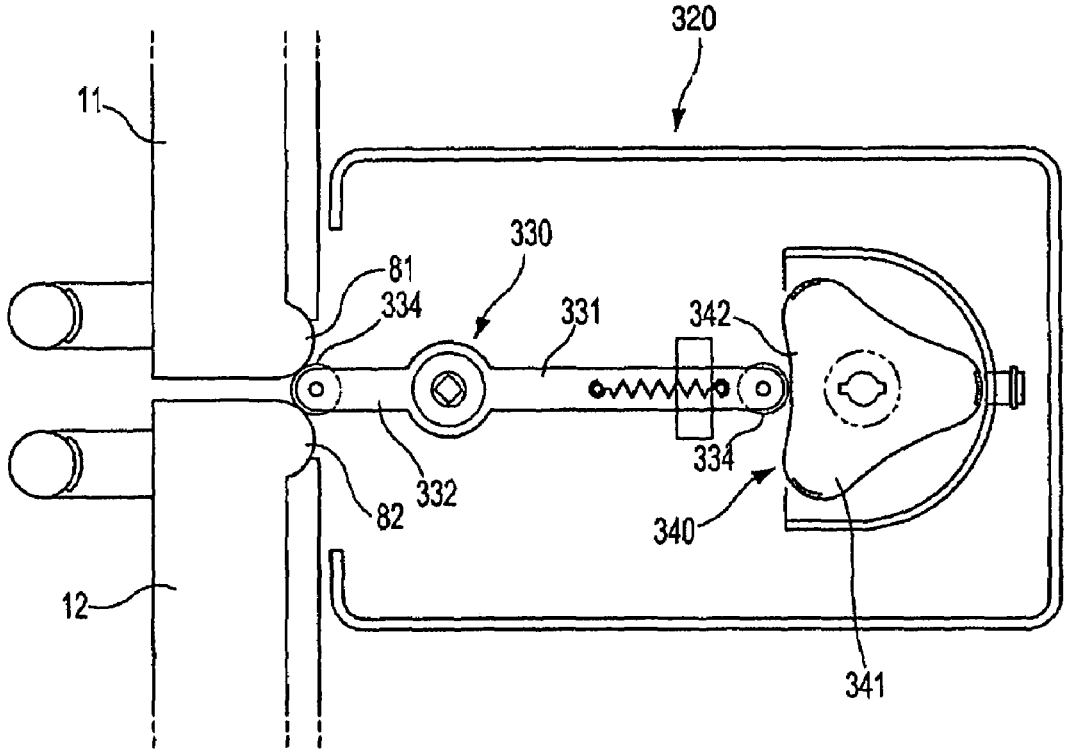
FIG. 12 is a top plan view illustrating a refrigerator equipped with a door opening device in accordance with a fourth embodiment.

FIG. 12 shows a door opening device in accordance with a fourth embodiment. A door opening device 320 according to the fourth embodiment includes an operating member 330, which has a different shape from the operating member of the first embodiment, and a first curved protrusion 81 and a second curved protrusion 82 which are respectively formed at the inner surfaces of the first door 11 and the second door 12. The first curved protrusion 81 and the second curved protrusion 82 are positioned adjacently to each other. The operating member 330 includes a first extending portion 331 which has a length such that a front end comes into contact with protruding portions 341 of a rotating cam 340 but is spaced apart from depressed portions 342 of the rotating cam 340, and a second extending portion 332 which extends between the first curved protrusion 81 and the second curved protrusion 82 and selectively pressurizes the first and second curved protrusions 81 and 82 according to the rotational direction of the rotating cam 340. The first and second extending portions 331 and 332 are respectively provided with rollers 334 at the front ends of the first and second extending portions 331 and 332. As the rotating cam 340 rotates, the operating member 330 rotates in the clockwise or counterclockwise direction and pressurizes the first curved protrusion 81 or the second curved protrusion 82 so as to selectively open the first door 11 and the second door 12. Since the other constitutions and operational mechanisms of this embodiment are similar to those of the first embodiment, the description thereof will be omitted.

Figure 13:
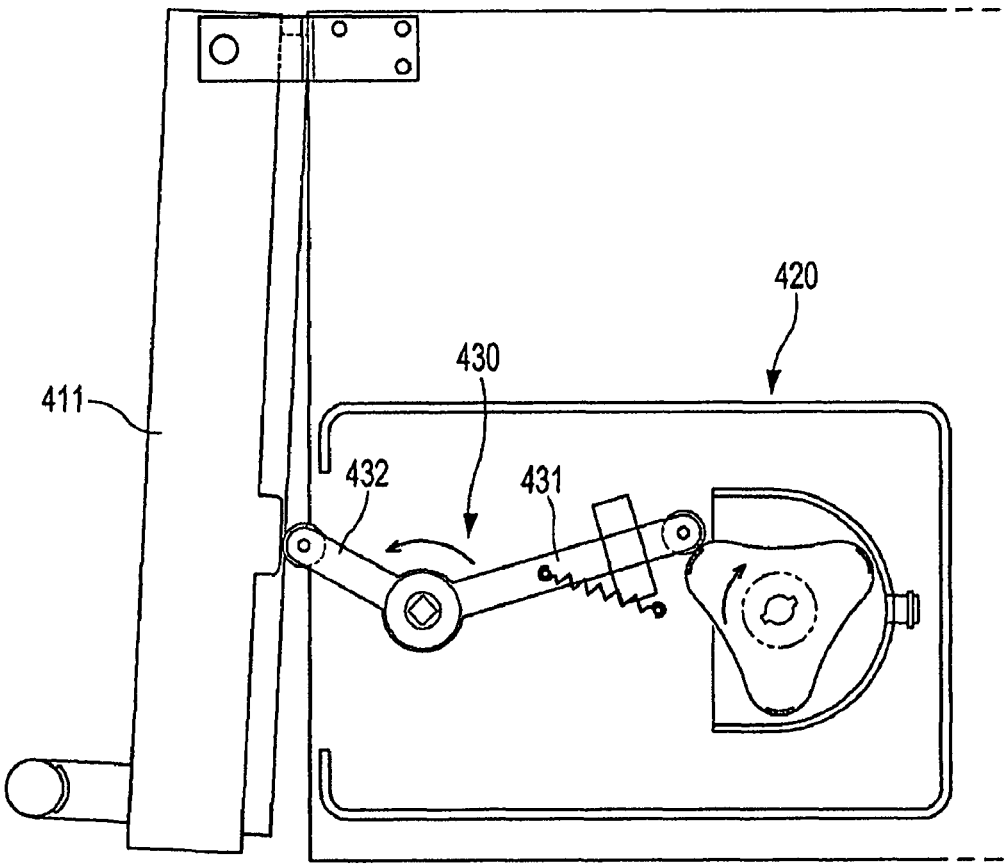
FIG. 13 is a top plan view illustrating a refrigerator equipped with a door opening device in accordance with a fifth embodiment.

FIG. 13 shows a door opening device in accordance with a fifth embodiment. A refrigerator equipped with a door opening device 420 of the fifth embodiment is a refrigerator which has a single door 411. Compared with the first embodiment, the door opening device 420 of this embodiment has structural features such that an operating member 430 does not have a third extending portion. In other words, the operating member 430 has only a first extending portion 431 and a second extending portion 432. Also, because the door opening device 420 functions to open just one door 411, a driving motor is configured to rotate in one direction. Since the other constitutions and operational mechanisms of this embodiment are similar to those of the above embodiments, the description thereof will be omitted.

As apparent from the above description, the door opening device according to the present embodiments can perform the operation of opening the door only by the rotation of the driving motor by a predetermined angle in one direction, and then instantly return to the initial state, although the driving motor does not rotate in the reverse direction. Accordingly, the operational stages of the driving motor can be minimized. As a result, lifespans of the driving motor and other related components are increased.

Also, when opening the first door and the second door consecutively, the doors can be opened only by the simple operation of the driving motor such that the driving motor rotates in the clockwise direction and subsequently rotates in the counterclockwise direction. Accordingly, in comparison with a conventional device, the operational stages of the driving motor decrease considerably, and as a result both the doors can be opened swiftly.

Also, since the rotating cam and the inner surface of the door contact the anti-vibration band of each roller, noise due to the shaking or vibration of the operating member and the rotating cam can be prevented during the operation of the door opening device.

Also, since the operating member rotates slowly by the action of the weight and the rotation resistive unit while returning to its initial position, the phenomenon that the operating member collides with the rotating cam or shakes can be minimized.

Although embodiments have been shown and described, it would be appreciated by those skilled in the art that changes may be made in these embodiments without departing from the principles and spirit of the invention, the scope of which is defined in the claims and their equivalents.

What is claimed is:

1. A door opening device selectively opening a first door and a second door, comprising:

an operating member selectively pressurizing the first door and the second door to be opened by rotation;

a rotating cam having a plurality of protruding portions contacting the operating member to rotate the operating member and a plurality of depressed portions spaced apart from the protruding portions, the protruding portions and the depressed portions being formed alternately along a rotational direction of the rotating cam;

a driving motor rotating the rotating cam in a forward direction and a reverse direction;

a return part returning the operating member to an initial position after at least one of the first door and the second door is opened; and a sensing unit detecting a rotational position of the rotating cam to control operation of the driving motor, the sensing unit including magnets provided at front ends of the protruding portions and a sensor provided outside the rotating cam to sense the magnets.

2. The door opening device according to claim 1, wherein the rotating cam is configured such that the protruding portions are formed at 120 degrees between two adjacent protruding portions.

3. A door opening device selectively opening a first door and a second door, comprising:

an operating member selectively pressurizing the first door and the second door to be opened by rotation;

a rotating cam having a plurality of protruding portions contacting the operating member to rotate the operating member and a plurality of depressed portions spaced apart from the protruding portions, the protruding portions and the depressed portions being formed alternately along a rotational direction of the rotating cam;

a driving motor rotating the rotating cam in a forward direction and a reverse direction; and a return part returning the operating member to an initial position after at least one of the first door and the second door is opened, wherein the operating member includes a first extending portion extending toward the rotating cam and having a length such that a front end of the first extending portion contacts the protruding portions and is spaced apart from the depressed portions, a second extending portion extending toward an inner surface of the first door and pressurizing the first door when rotating in a first direction, and a third extending portion extending toward an inner surface of the second door and pressurizing the second door when rotating in a second direction.

4. The door opening device according to claim 3, wherein the operating member is configured such that the length between the front end of the first extending portion and a rotational center of the operating member is larger than a length between a front end of the second extending portion or a front end of the third extending portion, and the rotational center.

5. The door opening device according to claim 3, wherein the operating member further includes rollers provided at the front ends of the first extending portion, the front end of the second extending portion and the front end of the third extending portion.

6. The door opening device according to claim 5, wherein each of the rollers has an anti-vibration band provided around an outer surface thereof.

7. The door opening device according to claim 3, wherein the first extending portion of the operating member is aligned with one of the depressed portions of the rotating cam in an initial state.

8. The door opening device according to claim 5, further comprising:

a weight mounted on at least one of the first extending portion, the second extending portion and the third extending portion and disposed at a position distant from a rotational center of the operating member.

9. The door opening device according to claim 1, further comprising:

a first curved protrusion formed at an inner surface of the first door; and a second curved protrusion formed at an inner surface of the second door and positioned adjacent to the first curved protrusion, wherein the operating member includes a first extending portion extending toward the rotating cam and having a length such that of the first extending portion a front end contacts the protruding portions of the rotating cam and is spaced apart from the depressed portions of the rotating cam, and a second extending portion extending between the first curved protrusion and the second curved protrusion and selectively pressurizing the first curved portion and the second curved protrusion according to a rotational direction of the operating member.

10. The door opening device according to claim 9, wherein the operating member further includes rollers provided at the front ends of the first extending portion and a front end of the second extending portion.

11. The door opening device according to claim 1, further comprising:

a rotation resistive unit applying rotation resistance to the operating member to rotate the operating member slowly.

12. The door opening device according to claim 11, wherein the rotation resistive unit includes a rotary type oil damper mounted to a rotational center portion of the operating member.

13. The door opening device according to claim 1, wherein the first door and the second door are provided with handles, and the door opening device further includes manipulating parts provided at the handles to control operation of the driving motor.

14. A refrigerator including a main body having a first storage compartment and a second storage compartment partitioned from each other, a first door allowing access to the first storage compartment, a second door allowing access to the second storage compartment, and a door opening device selectively opening the first door and the second door, the door opening device comprising:

an operating member selectively pressurizing the first door and the second door to be opened by rotation;

a rotating cam including a plurality of protruding portions contacting the operating member to rotate the operating member and a plurality of depressed portions spaced apart from the operating member, the protruding portions and the depressed portions being formed alternately along a rotational direction of the rotating cam;

a driving motor rotating the rotating cam in a forward direction and a reverse direction;

a return part returning the operating member to an initial position after at least one of the first door and the second door is opened;

a sensing unit detecting a rotational position of the rotating cam to control operation of the driving motor, the sensing unit including magnets provided at front ends of the protruding portions and a sensor provided outside the rotating cam to sense the magnets.

15. The refrigerator according to claim 14, wherein the rotating cam is configured such that the protruding portions are formed at 120 degrees between two adjacent protruding portions.

16. A refrigerator including a main body having a first storage compartment and a second storage compartment partitioned from each other, a first door allowing access the first storage compartment, a second door allowing access the second storage compartment, and a door opening device selectively opening the first door and the second door, the door opening device comprising:

an operating member selectively pressurizing the first door and the second door to be opened by rotation;

a rotating cam including a plurality of protruding portions contacting the operating member to rotate the operating member and a plurality of depressed portions spaced apart from the operating member, the protruding portions and the depressed portions being formed alternately along a rotational direction of the rotating cam;

a driving motor rotating the rotating cam in a forward direction and a reverse direction; and a return part returning the operating member to an initial position after at least one of the first door and the second door is opened, wherein the operating member includes a first extending portion extending toward the rotating cam and having a length such that a front end of the first extending portion contacts the protruding portions and is spaced apart from the depressed portions, a second extending portion extending toward an inner surface of the first door and pressurizing the first door when rotating in a first direction, and a third extending portion extending toward an inner surface of the second door and pressurizing the second door when rotating in a second direction.

17. The refrigerator according to claim 16, wherein the operating member further includes rollers provided at the front ends of the first extending portion, a front end of the second extending portion and a front end of the third extending portion.

18. The refrigerator according to claim 17, wherein each of the rollers has an anti-vibration band provided around an outer surface thereof.

19. The refrigerator according to claim 16, wherein the first extending portion of the operating member is aligned with one of the depressed portions of the rotating cam in an initial state.

20. The refrigerator according to claim 16, further comprising:

a weight mounted on at least one of the first extending portion, the second extending portion and the third extending portion and disposed at a position distant from a rotational center of the operating member.

21. The refrigerator according to claim 14, further comprising:

a first curved protrusion formed at an inner surface of the first door; and a second curved protrusion formed at an inner surface of the second door and positioned adjacent to the first curved protrusion, wherein the operating member includes a first extending portion extending toward the rotating cam and having a length such that a front end of the first extending portion contacts the protruding portions of the rotating cam and is spaced apart from the depressed portions of the rotating cam, and a second extending portion extending between the first curved protrusion and the second curved protrusion and selectively pressurizing the first curved portion and the second curved protrusion according to a rotational direction of the operating member.

22. The refrigerator according to claim 21, wherein the operating member further includes rollers provided at the front ends of the first extending portion and a front end of the second extending portion.

23. The refrigerator according to claim 14, further comprising:

a rotation resistive unit applying rotation resistance to the operating member to rotate the operating member slowly.

24. The refrigerator according to claim 14, wherein the first door and the second door are provided with handles, and the door opening device further includes manipulating parts provided at the handles to control operation of the driving motor.

* * * * *

UNITED STATES PATENT AND TRADEMARK OFFICE

CERTIFICATE OF CORRECTION

PATENT NO. : 7,819,488 B2
APPLICATION NO. : 11/882584
DATED : October 26, 2010
INVENTOR(S) : Dong Hyun Lee et al.

It is certified that error appears in the above-identified patent and that said Letters Patent is hereby corrected as shown below:

Column 11, Line 41 in Claim 9, delete "of the first extending portion a front end" and insert -- a front end of the first extending portion --, therefor.

Column 12, Line 62 in Claim 17, delete "ends" and insert -- end --, therefor.

Signed and Sealed this
Eighth Day of February, 2011

David J. Kappos

David J. Kappos
*Director of the United States Patent and Trademark Office*